United States Patent [19]

Joppig et al.

[11] Patent Number: 4,557,233

[45] Date of Patent: Dec. 10, 1985

[54] CONTROL ARRANGEMENT FOR AN ENGINE EXHAUST BRAKE

[75] Inventors: Peter Joppig, Korb; Bernard Peitz, Baltmannsweiler; Dieter Woschee, Esslingen, all of Fed. Rep. of Germany

[73] Assignee: Daimler-Benz Aktiengesellschaft, Stuttgart, Fed. Rep. of Germany

[21] Appl. No.: 666,053

[22] Filed: Oct. 29, 1984

[30] Foreign Application Priority Data

Oct. 28, 1983 [DE] Fed. Rep. of Germany ..... 3339053

[51] Int. Cl.[4] ..... F02D 9/06

[52] U.S. Cl. ..... 123/323; 188/273

[58] Field of Search ..... 123/323, 345, 346, 347, 123/348; 188/273

[56] References Cited

U.S. PATENT DOCUMENTS

| | | | |
|---|---|---|---|
| 3,960,122 | 6/1976 | Perrin | 123/323 |
| 4,023,358 | 5/1977 | Maurer et al. | 123/198 F |
| 4,149,618 | 4/1979 | Horie | 123/323 |
| 4,335,849 | 6/1982 | Van Bashuysen | 123/323 |
| 4,393,831 | 7/1983 | Bergmann et al. | 123/323 |
| 4,426,986 | 1/1984 | Müller et al. | 123/323 |

FOREIGN PATENT DOCUMENTS

| | | | |
|---|---|---|---|
| 2625095 | 12/1977 | Fed. Rep. of Germany | 188/273 |
| 3041638 | 5/1982 | Fed. Rep. of Germany | 123/323 |

*Primary Examiner*—William A. Cuchlinski, Jr.
*Attorney, Agent, or Firm*—Barnes & Thornburg

[57] ABSTRACT

An exhaust brake system for internal combustion engines includes an exhaust valve within the exhaust duct which is closed or opened for the braking of a vehicle during engine operation by means of an engine brake valve. A magnetic valve is arranged within the control duct and is controlled by an electrical circuit connected to a terminal of the ignition switch and to the positive terminal of the generator in such a manner that the exhaust valves are closed during the starting of the engine and when the engine is idling. The formation of white exhaust smoke during cold starting of the engine and the formation of blue exhaust smoke during idling of the engine is decreased.

18 Claims, 2 Drawing Figures

Fig.1
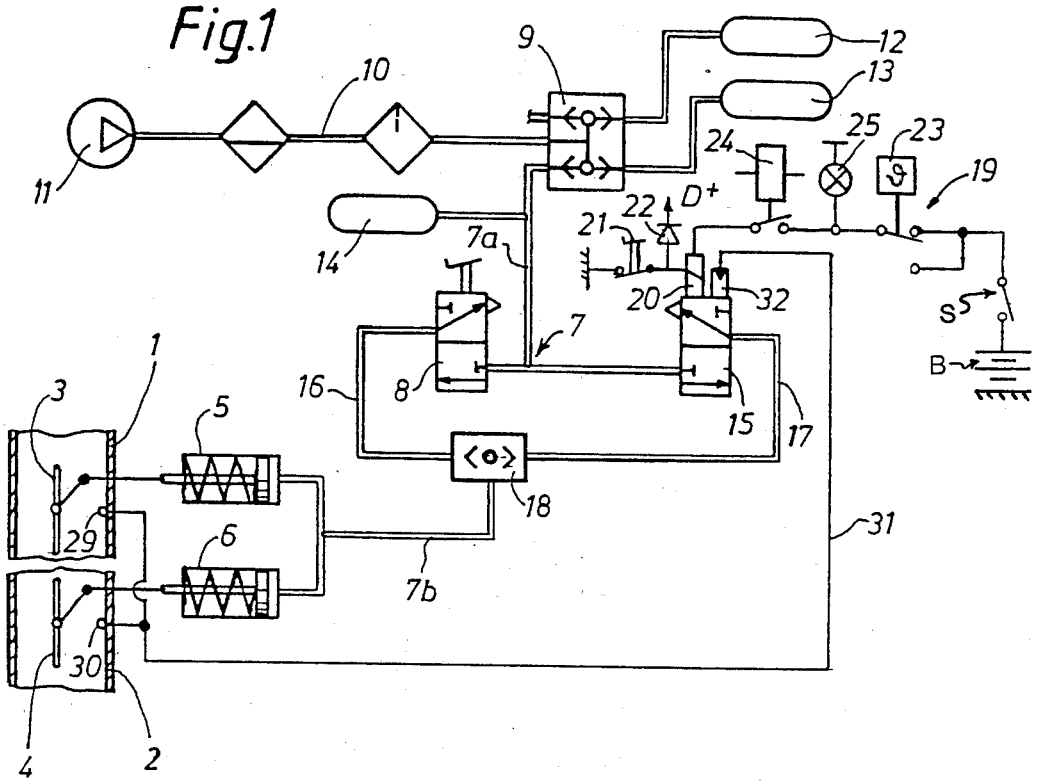
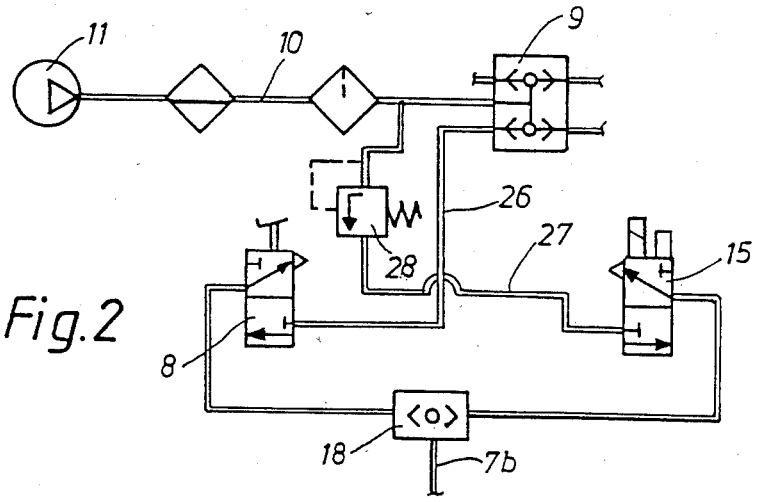
Fig.2

CONTROL ARRANGEMENT FOR AN ENGINE EXHAUST BRAKE

BACKGROUND AND SUMMARY OF THE INVENTION

This invention relates to a control arrangement for an engine exhaust brake of the type having a controllable exhaust valve located in the exhaust system.

Unexamined Published German patent application No. 2,625,095 shows an exhaust brake arrangement wherein the exhaust valve located in the exhaust system is operated by a control cylinder powered by air pressure. The control cylinder is connected to an air pressure storage container via an air pressure duct having a built-in engine brake valve. For activation of the engine brake, the engine brake valve is moved by means of the brake pedal into a position to admit air pressure into the control cylinder, thereby closing the exhaust valves. The control cylinders are vented by the engine brake valve upon completion of the braking operation, thereby opening the exhaust valves.

An object of the present invention is to provide a control arrangement for controlling the operation of the exhaust valves so as to eliminate the formation of white smoke in the exhaust gases following a cold engine start.

Another object of the present invention is to provide a control arrangement for controlling the operation of the exhaust valves so as to eliminate the formation of blue smoke in the exhaust gases when the engine is idling.

These and other objects are attained in a control arrangement for the exhaust brake of an internal combustion engine which comprises an exhaust valve located in the engine exhaust duct, air pressure actuated control means for operably moving the exhaust valve to open and closed positions, a first controlled connection between the pressure actuated control means and a source of pressurized air which includes a manually operated control element, a second controlled connection between the pressure actuated control means and a source of pressurized air which includes an electrically operated control element, and electrical circuit for controlling the operation of the electrically operated control element in response to selected engine operating conditions. This arrangement provides for the automatic closing of the exhaust valves prior to and during the cold starting of the engine so that the white smoke is retained within the exhaust duct, while allowing only a minimal amount of leakage. During the advanced stages of the engine starting process, the pistons of the internal combustion engine work against the dynamic pressure of the exhausts. This produces a very high working pressure within the cylinders so that ignition in the cylinder occurs more readily, thereby reducing white smoke formation. The blue smoke formation is also suppressed in the same manner during idling periods when the engine is warmed-up due to the closed exhaust valves.

An additional advantage of the present invention is that these measures, except for the control, are obtained by means of the existing engine brake without additional structural elements.

In a preferred embodiment of the invention, the electrically operated control element is a three-port, two position magnetic valve. In this embodiment, the connecting means includes a common duct extending from the source of pressurized air and connecting to a ring duct. The ring duct has a first branch which includes the manually operated control element, and a second branch which includes the electrically operated control element. The two branches are connected by a two-way valve to a second common duct which is further connected to the air pressure actuated control means.

In another embodiment, the branches containing the manually operated control element and the electrically operated control element are separately connected to the source of pressurized air. In this embodiment, the branch which includes the electrically operated control element also contains a relief valve.

The control circuitry is supplied with electric current by a battery via the ignition switch. The electrically operated control element includes an electrical actuator having a first terminal connected to a current supply portion of the control circuit, and a second terminal connected to a current return portion of the circuit. The second terminal of the electric actuator is connected to a positive terminal of a generator which is driven by the engine. The current supply portion of the electrical circuit includes a thermostatic switch which is reponsive to the operating temperature of the engine, and a brake switch which is responsive to the operating position of a hand-operated brake. The second terminal of the electrical actuator is connected to the generator terminal by diode means. This second terminal is further connected to a switch which is responsive to the operating position of the vehicle gas pedal to connect the second terminal to the current return portion of the circuit.

The preferred embodiment is also provided with pressure sensors arranged in the exhaust duct upstream of the exhaust valve. The pressure sensors are connected to the electrically operated control element by control circuitry for operating the element to open the exhaust valves in response to a pressure build-up in the exhaust duct.

Other objects, advantages and novel features of the present invention will become apparent from the following detailed description of the invention when considered in conjunction with the accompanying drawings.

BRIEF DESCRIPTION OF THE DRAWINGS

FIG. 1 shows an exhaust valve control arrangement in accordance with the present invention in which the air pressure duct is connected to the exhaust brake control system by a four-way safety valve.

FIG. 2 shows another embodiment of an exhaust valve control arrangement in accordance with the present invention which has separate control circuits for the manually operated brake valve and the electrically operated valve.

DETAILED DESCRIPTION OF THE DRAWINGS

FIG. 1 shows two exhaust ducts 1 and 2 of an internal combustion engine. Exhaust ducts 1 and 2 are provided with exhaust valves 3 and 4, respectively, which are pneumatically controlled to close or open the ducts by means of control cylinders 5 and 6. Control cylinders 5 and 6 are connected to a four-way safety valve 9 by an air pressure control duct 7 and a manually-activated engine brake valve 8. The four-way safety valve 9 is connected to an air pressure source 11 by an air pressure duct 10. The compressed air flowing from the air pressure source through duct 10 is divided by four-way safety valve 9 into four separate circuits, with each circuit incapable of receiving air from any of the other circuits. These include vehicle brake circuits I and II (represented in FIG. 1 by air pressure vessels 12 and 13) and other auxilliary circuits (represented by storage vessel 14). As can be seen in FIG. 1, control duct 7 is connected to the outlet which is also connected to storage vessel 14.

Engine brake valve 8 is a three port, two position valve having a ventilation position and a flow-through position. Control cylinders 5 and 6 are pressureless and exhaust valves 3 and 4 in the exhaust ducts are open when the valve is in the ventilation position. When engine brake valve 8 is brought into the flow-through position by operation of the engine brake, control cylinders 5 and 6 are connected to the pressurized air by control duct 7 and act to close exhaust valves 3 and 4 in exhaust ducts 1 and 2, respectively.

A three-port, two position magnetic valve 15 is provided in parallel with engine brake valve 8 in control duct 7, serving as an independently controlled positioning means for operating exhaust valves 3 and 4 of the engine brake control system for decreasing white and blue smoke formation in the exhaust gases. To simplify construction of control duct 7 for the separately activated valves 8 and 15, the control duct is formed from a single duct *7a* extending from four-way safety valve 9 and connected to a ring duct section having a duct branch 16 and a duct branch 17. Duct branches 16 and 17 connect to the inputs of a two-way valve 18 and single duct *7b* extends from the outlet of valve 18 to control cylinders 5 and 6.

The separate control of the two exhaust valves is achieved by connecting the engine brake valve 8 in duct branch 16 and magnetic valve 15 in duct branch 17. Two-way valve 18 is constructed so that air pressure is selectively available from either engine brake valve 8, via duct branch 16, or magnetic valve 15, via duct branch 17, to operate control cylinders 5 and 6.

Magnetic valve 15 is controlled by an electrical circuit 19 which is supplied with control current from a battery B via a control unit. The current flows through an actuating coil 20 to a return (ground) circuit via terminal D+ of the engine generator or via a grounding switch 21. The control unit includes ignition switch S which closes to energize electrical circuit 19 when the ignition switch is on. A diode 22 connects electrical circuit 19 to generator terminal D+ to provide the ground connection prior to and during the engine starting process.

Electrical circuit 19 further includes a thermostatic switch 23 responsive to the engine coolant temperature, and a hand-brake release switch 24. Both switches insure that magnetic valve 15 is not energized when the coolant is above a predetermined temperature (for example, plus 20° centigrade), or when the hand brake is released. The exhaust valves thereby would not be closed. A control light arranged between switches 23 and 24 indicates to the driver when exhaust valves 3 and 4 are closed.

The control arrangement according to FIG. 2 differs from the arrangement described in FIG. 1, in that engine brake valve 8 is connected to four-way safety valve 9 by a separate air pressure supply duct 26 and magnetic valve 15 is connected to air pressure duct 10 upstream of four-way safety valve 9 by separate air pressure supply duct 27. A relief valve 28 arranged in duct 27 is adjusted to a very low opening pressure, as compared to the opening pressure of four-way safety valve 9. At the same, relief valve 28 protects the air pressure system against a defect which could possibly occur within the air pressure supply duct 27. By providing for a priority opening of relief valve 28, a useable control pressure exists during the engine starting process prior to the pressure increase in the overall system.

To prevent the build-up of an excessively high exhaust gas back pressure in front of the closed valves 3 and 4, pressure sensors 29 and 30 are provided within the exhaust ducts upstream from the exhaust valves. Pressure sensors 29 and 30 are connected by a sensor control line 31 to a pressure transformer switch 32 located at magnetic valve 15 which vents control duct 17 via magnetic valve 15 in the event a predetermined pressure build-up is reached, thereby opening exhaust valves 3 and 4.

The operation of the control arrangement of FIG. 1 will now be described. In a standing vehicle with a cold engine, switches 21, 23, and 24 are closed. The ignition switch is moved into the ignition position to begin the engine starting process. A control current flows through actuating coil 20 of valve 15 to ground and magnetic valve 15 moves to the flow-through position. If residual pressure is present in storage vessel 14, control cylinders 5 and 6 are immediately activated via ducts *7a*, 17, and *7b* and exhaust valves 3 and 4 are closed. If there is no residual pressure present in storage vessel 14, the pressure build-up occurs during the engine starting process. Compressed air is supplied from air pressure producer 11 via duct 10 to four-way safety valve 9. Air is guided from there into control duct section *7a* via the connection to storage container 14. The compressed air reaches control cylinders 5 and 6 via duct branch 17 and magnetic valve 15 causing exhaust valves 3 and 4 to close. Since the gas pedal is used during the engine starting process, switch 21 is opened. The ground connection for the electrical actuator is maintained by terminal D+ of the generator which is still at a relatively negative potential. As soon as the engine starting process has been completed and the engine is idling (i.e., the gas pedal is no longer used), grounding switch 21 is closed. Terminal D+, which by now is positive with respect to ground, is isolated from the electrical current in the circuit by diode 22. When the coolant reaches a certain temperature or the vehicle is prepared for motion by releasing the hand brake, the current will be interrupted. Actuating coil 20 is de-energized and magnetic valve 15 moves into the ventilation position. The pressure at control cylinders 5 and 6 therefore drops, the cylinders return to their starting position, and exhaust valves 1 and 2 are opened.

Switches 21 and 24 are closed with a standing vehicle and an operationally warm engine. Thermostatic switch 23 is constructed as a multi-position switch which again reaches a closing position when the coolant temperature is above about 80° centigrade and thereby is also closed. This allows a control current to flow to valve 15 via the electrical circuit 19 and grounding switch 21. This causes magnetic valve 15 to move to the flow-through position so that exhaust valves 3 and 4 are closed and formation of blue smoke in the exhaust gases is prevented.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. Control arrangement for an exhaust brake of an internal combustion engine, comprising:

an exhaust valve located in an engine exhaust duct;

air-pressure actuated control means for operably moving the exhaust valve to open and closed positions;

first means for selectively connecting said air pressure actuated control means to a source of pressurized air, said first connecting means including a manually operated control element;

second means for selectively connecting said air pressure actuated control means to a source of pressurized air, said connecting means including an electrically operated control element; and circuit means for controlling the operation of said electrically operated control element in response to engine operating conditions.

2. Control arrangement according to claim 1, wherein said electrically operated control element is a three-port, two position magnetic valve.

3. Control arrangement according to claim 2, wherein said first connecting means comprises a first common duct extending from the source of pressurized air and connecting to a ring duct, a first branch of the ring duct extending from the connecting point of the common duct to a first inlet port of a two-way valve, and a second common duct extending from an outlet port of the two-way valve to said air pressure actuated control means; and wherein said second connecting means comprises said first common duct, a second branch of the ring duct extending from the connecting point of the common duct to a second inlet port of the two-way valve, and said second common duct; and wherein said manually operated control element is arranged in said first branch of the ring duct and said two-position magnetic valve is arranged in said second branch of the ring duct.

4. Control arrangement according to claim 3, wherein said first common duct is connected to an outlet port of a distribution valve, said distribution valve having an inlet port connected to means for producing pressurized air.

5. Control arrangement according to claim 3, wherein said manually operated control element is arranged in said first branch of the ring duct and said electrically operated control element is arranged in said second branch of the ring duct.

6. Control arrangement according to claim 5, wherein said first common duct is connected to an outlet port of a distribution valve, said distribution valve having an inlet port connected to means for producing pressurized air.

7. Control arrangement according to claim 2, wherein said electrically operated control element is operated, and said exhaust valve is thereby closed, during engine idling operations when engine coolant temperatures are above a second predetermined temperature value.

8. Control arrangement according to claim 1, wherein said first connecting means further includes a distribution valve having an inlet port connected to a source of pressurized air and an outlet port connected to the manually operated control element, and wherein said second connecting means further includes a relief valve having an inlet port connected to the source of pressurized air at a point upstream of the inlet port of the distibution valve, and said relief valve having an outlet port connected to the electrically operated control element.

9. Control arrangement according to claim 1, wherein said circuit means is connected to a battery by an ignition switch.

10. Control arrangement according to claim 1, wherein said electrically operated control element includes an electric actuator having a first terminal connected to a current supply portion of said circuit means and having a second terminal connected to a current return portion of said circuit means, and wherein said second terminal is connected to a positive terminal of a generator driven by the engine.

11. Control arrangement according to claim 10, wherein said current supply portion includes a thermostatic switch responsive to the operating temperature of the engine, and a brake switch responsive to the operating position of a hand-operated brake.

12. Control arrangement according to claim 11, wherein the thermostatic switch is closed when engine coolant temperatures are below a first predetermined coolant temperature, open when engine coolant temperatures are above said first pre-determined temperature but below a second predetermined temperature, and closed when said coolant temperatures are above said second predetermined temperature.

13. Control arrangement according to claim 10, wherein said second terminal is connected to the generator terminal by diode means.

14. Control arrangement according to claim 10, wherein said second terminal is further connected to switching means, responsive to an operating position of the vehicle gas pedal, for connecting said second terminal to the current return portion of the circuit means.

15. Control arrangement according to claim 1 further comprising pressure sensing means arranged in the engine exhaust duct upstream of said exhaust valve.

16. Control arrangement according to claim 15, wherein said pressure sensing means is connected to the electrically operated control element by control means for operating said element in response to a predetermined pressure build-up in the exhaust duct.

17. Control arrangement according to claim 1, wherein said electrically operated control element is operated, and said exhaust valve is thereby closed, during engine starting when engine coolant temperatures are below a first predetermined temperature value.

18. Control arrangement according to claim 1, wherein said electrically operated control element is operated, and said exhaust valve is thereby closed, during engine idling operations when engine coolant temperatures are below a first predetermined temperature value.

* * * * *